US009874052B2

(12) United States Patent
Gilkey

(10) Patent No.: US 9,874,052 B2
(45) Date of Patent: Jan. 23, 2018

(54) WINDOW MAINFRAME COMPONENT FOR EMERGENCY ESCAPE AND RESCUE OPENING WINDOWS

(71) Applicant: Gilkey Window Company, Cincinnati, OH (US)

(72) Inventor: Michael Gilkey, Loveland, OH (US)

(73) Assignee: Gilkey Window Company, Cincinnati, OH (US)

( * ) Notice: Subject to any disclaimer, the term of this patent is extended or adjusted under 35 U.S.C. 154(b) by 0 days.

(21) Appl. No.: 15/005,494

(22) Filed: Jan. 25, 2016

(65) Prior Publication Data

US 2017/0211310 A1 Jul. 27, 2017

(51) Int. Cl.

| | |
|---|---|
| ***E06B 3/00*** | (2006.01) |
| ***E06B 1/36*** | (2006.01) |
| ***E06B 3/44*** | (2006.01) |
| ***E06B 3/22*** | (2006.01) |
| *E06B 9/40* | (2006.01) |

(52) U.S. Cl.

CPC ..... *E06B 1/36* (2013.01); *E06B 3/22* (2013.01); *E06B 3/4415* (2013.01); *E06B 9/40* (2013.01); *E06B 2003/4461* (2013.01)

(58) Field of Classification Search

CPC ... E06B 1/36; E06B 3/4415; E06B 2003/4461
USPC ..... 52/204.1, 211
See application file for complete search history.

(56) References Cited

U.S. PATENT DOCUMENTS

| | | | | |
|---|---|---|---|---|
| 4,858,405 A * | 8/1989 | Christie | E06B 3/28 | 52/202 |
| 5,123,212 A * | 6/1992 | Dallaire | E06B 7/14 | 49/408 |
| 5,491,940 A * | 2/1996 | Bruchu | B29C 65/20 | 49/504 |
| 5,553,903 A | 9/1996 | Prete et al. | | |
| 5,603,585 A * | 2/1997 | Bruchu | B29C 65/20 | 403/382 |
| D378,430 S | 3/1997 | Dallaire et al. | | |
| D378,546 S | 3/1997 | Dallaire et al. | | |
| 5,622,017 A * | 4/1997 | Lynn | B29C 65/20 | 52/204.5 |
| D382,072 S | 8/1997 | Dallaire et al. | | |
| 5,687,533 A * | 11/1997 | Bruchu | E06B 3/9636 | 403/231 |
| D414,278 S | 9/1999 | Dallaire et al. | | |
| 6,178,695 B1 | 1/2001 | Kornegay et al. | | |
| 6,182,405 B1 * | 2/2001 | Lindahl | E06B 1/003 | 52/202 |
| 6,854,214 B2 | 1/2005 | Polowinczak | | |

(Continued)

FOREIGN PATENT DOCUMENTS

| | | | |
|---|---|---|---|
| FR | 2703722 A1 * | 10/1994 | E06B 1/30 |
| GB | 2158496 A | 11/1985 | |
| WO | WO 2005040536 A2 * | 5/2005 | E05D 13/08 |

OTHER PUBLICATIONS

International Search Report and Written Opinion, dated May 2, 2017, pertaining to PCT/US2017/014697.

*Primary Examiner* — Charles A Fox
*Assistant Examiner* — James J Buckle, Jr.
(74) *Attorney, Agent, or Firm* — Dinsmore & Shohl LLP

(57) ABSTRACT

Embodiments of windows mainframe components, for example, head/jamb window mainframe components which meet the egress requirements for egress windows are provided herein.

20 Claims, 6 Drawing Sheets

(56) References Cited

U.S. PATENT DOCUMENTS

| | | | | |
|---|---|---|---|---|
| 6,883,276 | B1 * | 4/2005 | Hannan | E06B 3/44 49/428 |
| 7,263,808 | B2 * | 9/2007 | Massey | E05C 9/1808 52/204.1 |
| 8,024,898 | B2 * | 9/2011 | Alvarado | E06B 1/02 52/204.1 |
| 8,857,129 | B2 * | 10/2014 | Beranek | E06B 3/9682 52/204.5 |
| 2005/0146143 | A1 | 7/2005 | Lutfallah | |
| 2007/0074469 | A1 * | 4/2007 | Plagemann | E06B 1/30 52/204.1 |
| 2010/0313488 | A1 | 12/2010 | Liang et al. | |
| 2012/0137635 | A1 | 6/2012 | Phandanouvong | |
| 2013/0111847 | A1 * | 5/2013 | Emanuel | E06B 3/22 52/656.9 |
| 2014/0041326 | A1 * | 2/2014 | Kadavy | E06B 7/16 52/209 |

* cited by examiner

WINDOW MAINFRAME COMPONENT FOR EMERGENCY ESCAPE AND RESCUE OPENING WINDOWS

BACKGROUND

Embodiments of the present disclosure generally relate to window mainframe components, and more particularly relate to window mainframe components suitable for meeting Emergency Escape and Rescue Opening window requirements.

SUMMARY

Emergency Escape and Rescue Opening windows are windows required in specific locations in a dwelling (for example, a basement or bedroom), which provide an emergency means of exiting a dwelling. As used in this application, "Emergency Escape and Rescue Opening windows" are synonymous and may be used interchangeably with the term "egress windows." While local regulations may specify different size requirements for an egress window, there is the model International Residential Code (IRC) criteria, which generally sets the minimum of what state and local jurisdictions are adopting or will adopt in their local regulations. The IRC criteria has 4 major size requirements for egress windows: 1) a minimum window opening width of 20 inches (in); 2) a minimum window opening height of opening of 24 in; 3) a minimum net clear opening of 5.7 sq. ft. (5.0 sq. ft. for ground floor); and 4) a maximum sill height above floor of 44 in.

Existing dwellings with windows installed prior to the adoption of egress regulations may be exempt from complying with the egress regulations, at least for now. However, new building and housing construction must meet egress requirements. Preferably, newly installed replacement windows must also meet egress requirements; however, the existing window "rough stud openings," brick openings, or mainframe "box" openings typically cannot fit and/or accommodate the newer, higher performing (Energy Code) replacement window mainframes and window sashes required, while keeping the home building code compliant in regards to Emergency Escape and Rescue requirements, and egress requirements. Consequently, to ensure the window opening is wide enough, the window opening often needs to be widened by removing brick, drywall or the like from the dwelling structure. Creating a new window opening while replacing the windows greatly increases costs. Accordingly, there is a need for improvements to egress window installation, which eliminate the need for remaking the window opening.

The embodiments of the present disclosure meet that need by providing improved window mainframe components that provide the requisite support for window sashes, while complying with egress requirements.

According to one embodiment, a head/jamb window mainframe component for egress windows is provided. The head/jamb window mainframe component comprises a horizontal block having a first surface configured to abut a window opening along perimeter sections of the window opening and a second surface opposite the first surface, an exterior boss extending from the second surface and disposed at one edge of the second surface of the horizontal block, wherein the exterior boss comprises a blind stop channel, and an interior boss extending from the second surface and disposed at an edge of the second surface opposite the edge in which the exterior boss is disposed. The head/jamb window mainframe component also comprises a plurality of vertical beams comprising at least a first vertical beam and a second vertical beam, the plurality of vertical beams extending from the second surface in between the interior boss and the exterior boss, wherein the first vertical beam and the second vertical beam are spaced apart and each have flanged ends operable for attachment to a window sash, and a plurality of balance shoe tracks comprising at least a first balance shoe track and a second balance shoe track, wherein the first balance shoe track is a channel formed in spacing between the first vertical beam and the exterior boss, and the second balance shoe track is a channel formed in spacing between the second vertical beam and the interior boss, wherein the first balance shoe track and the second balance shoe track have a depth of one inch or less. Moreover, the head/jamb window mainframe component comprises an attachable blind stop comprising a slidable flange member configured to slidingly engage the blind stop channel of the exterior boss, and a sash back stop member extending a distance beyond a horizontal plane defined by the flanged ends of the first vertical beam and the second vertical beam.

According to another embodiment, an egress window assembly comprising a window opening, and a window mainframe is provided. The window mainframe is attached along a perimeter of the window opening, the window mainframe comprising a head jamb, a sill, and side jambs disposed therebetween, wherein the head jamb, the side jambs, or both comprise a head/jamb window mainframe component as described above. The window sash attached to window mainframe, wherein at least a portion of the sash back stop member extends a distance beyond an upper edge of the window sash.

Additional features and advantages will be set forth in the detailed description which follows, and in part will be readily apparent to those skilled in the art from that description or recognized by practicing the embodiments described herein, including the detailed description which follows and the claims.

It is to be understood that both the foregoing general description and the following detailed description describe various embodiments and are intended to provide an overview or framework for understanding the nature and character of the claimed subject matter.

Figure 1:
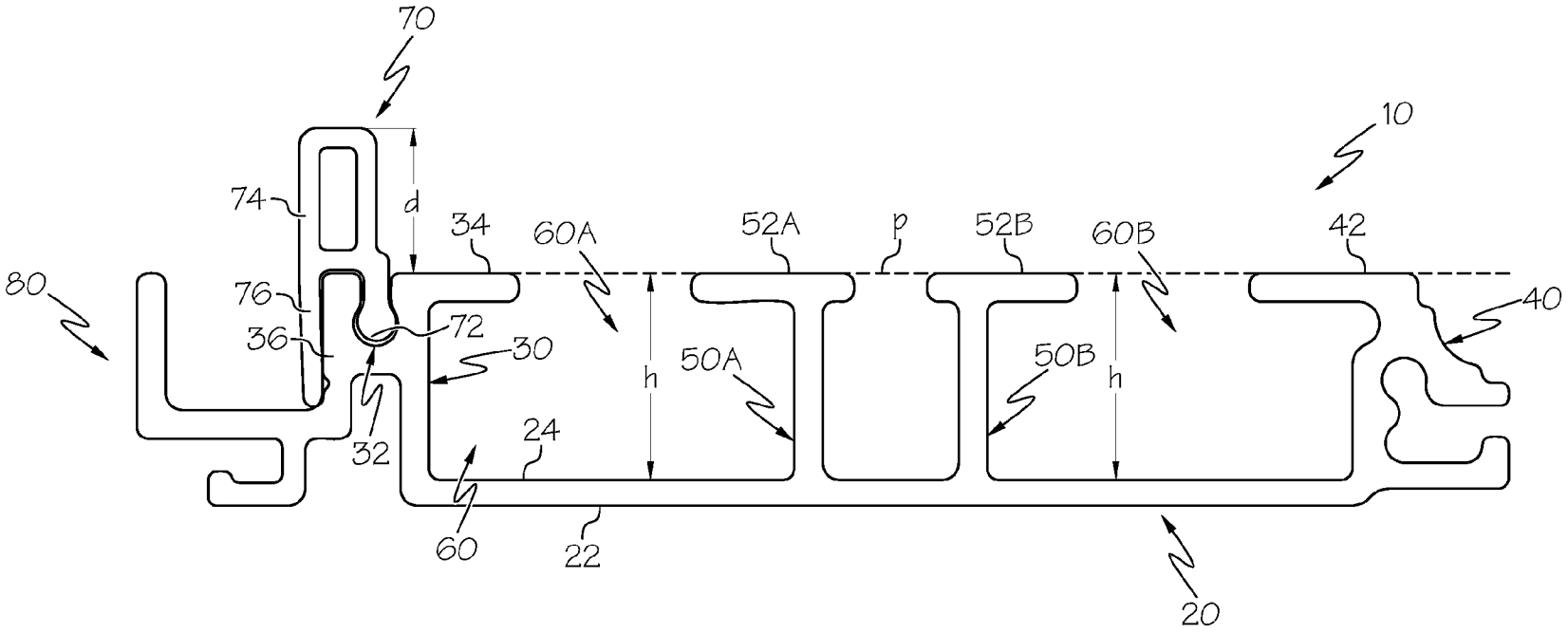
FIG. 1 is a side view of a window mainframe component in accordance with one or more embodiments of the present disclosure.

The embodiments set forth in the drawings are illustrative in nature and not intended to be limiting to the claims.

Moreover, individual features of the drawings will be more fully apparent and understood in view of the detailed description.

DETAILED DESCRIPTION

Reference will now be made in detail to various embodiments of window mainframe components suitable for meeting egress window requirements.

Figure 2:
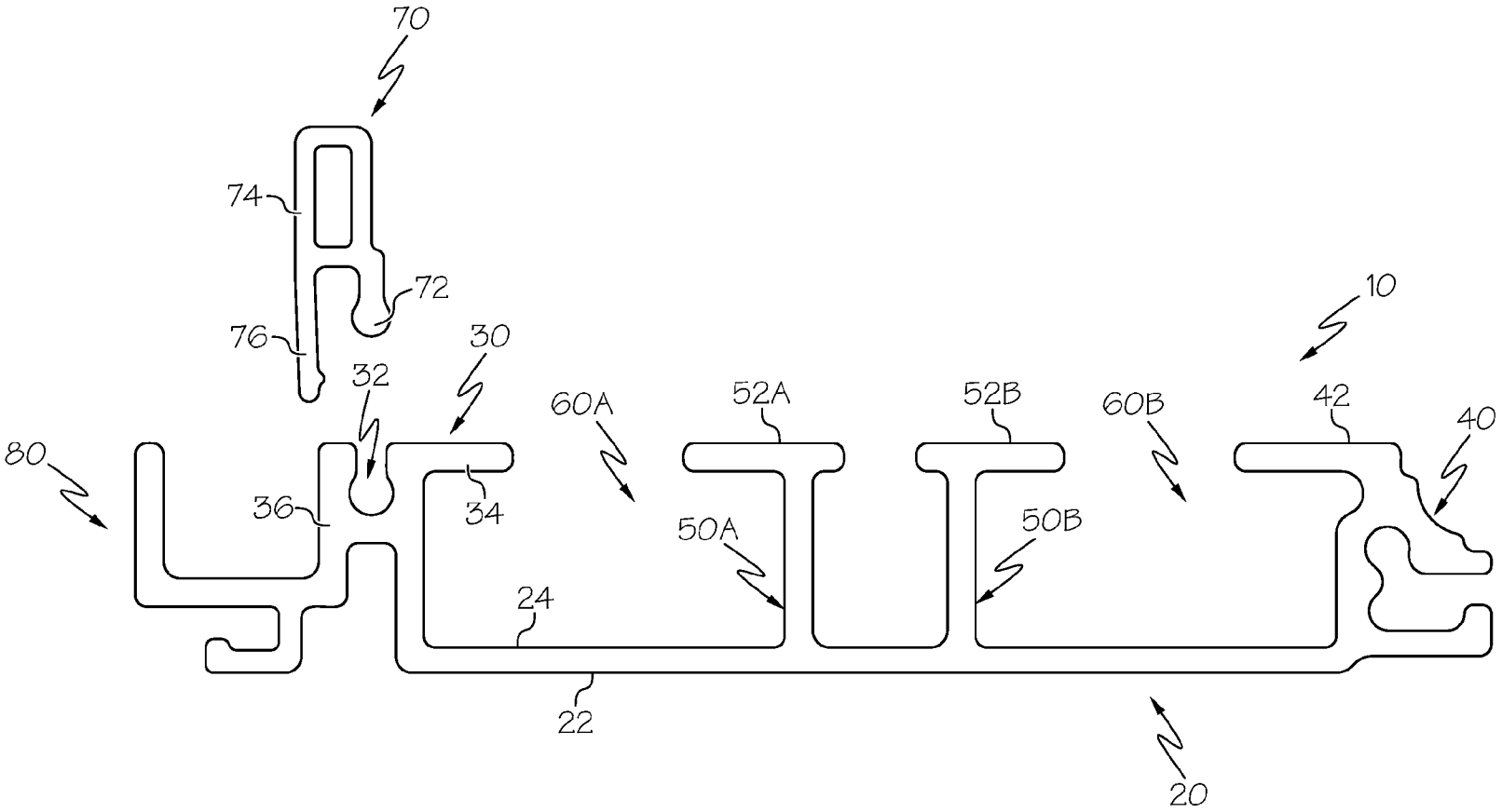
FIG. 2 is a side exploded view of a window mainframe component in accordance with one or more embodiments of the present disclosure.
Figure 4:
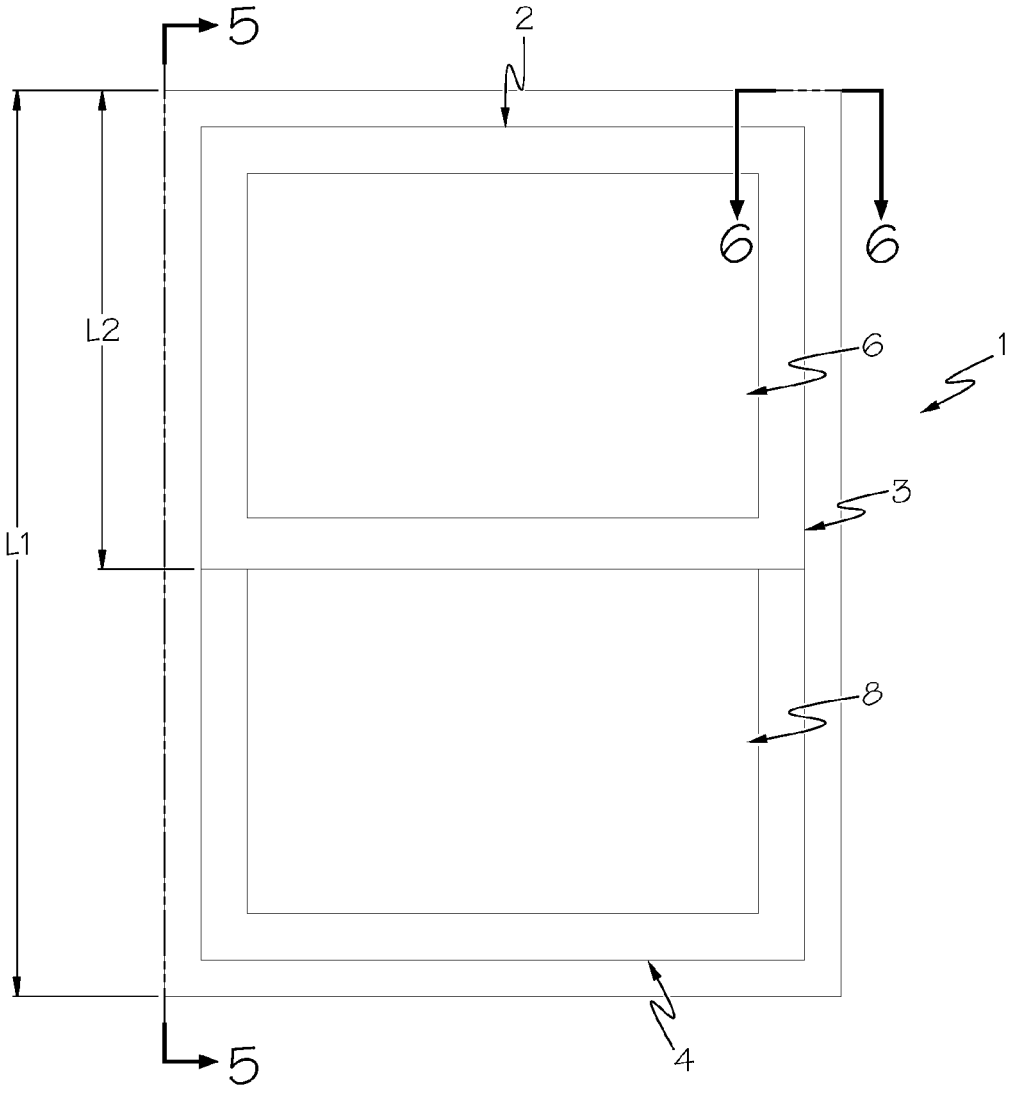
FIG. 4 is a double hung window annotated to illustrate the locations of the window mainframe components.

Referring to FIGS. 1 and 2, a head/jamb window mainframe component 10 for egress windows is shown. As used herein and illustrated in FIG. 4, "head/jamb window mainframe component" means a window mainframe component that can be used in the head 2 of an egress window assembly 1, the jamb 3 of the window mainframe or both the head 2 and jamb 3 of the window mainframe. Referring to FIG. 4, the head 2 of the window mainframe 1 means the upper side of the window mainframe, the sill 4 of the window mainframe means the lower side of the window mainframe, and the jamb 3 of the window mainframe means the sides of the window mainframe disposed between the head 2 and sill 4. For even further clarity, the window mainframe as depicted in FIG. 4 are the support structures disposed on the perimeter of the window opening and configured to support the top and bottom window sashes 6 and 8.

Figure 3:
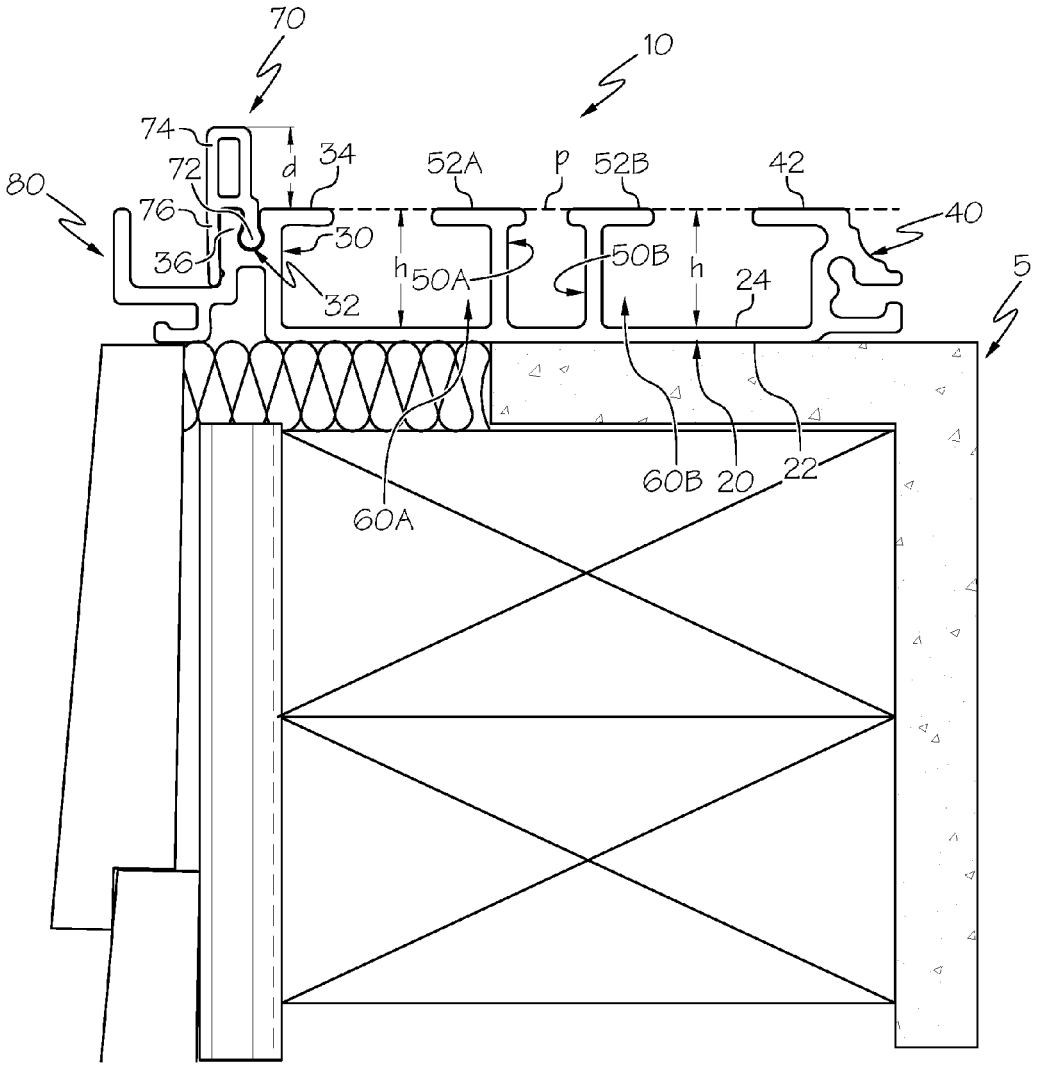
FIG. 3 depicts the window mainframe component abutting a window opening in accordance with one or more embodiments of the present disclosure.

Referring to FIGS. 1-3, 5, and 6, the head/jamb window mainframe component 10 comprises a horizontal block 20 having a first surface 22 configured to abut a window opening and a second surface 24 opposite the first surface 22. FIG. 3 depicts the head/jamb window mainframe component 10 abutting perimeter sections of the window opening 5. As used herein, "window opening" means the space or cavity in the dwelling, building, or home where the window mainframe and window sashes may be inserted and installed. Thus, the window opening is a hole in the brick, wood, or drywall of the building or home. Here, the head/jamb window mainframe component 10 abuts the window frame along one or more sections of the perimeter of the window opening 5, specifically the perimeter sections that correspond to the head and/or jamb of the window mainframe.

Referring again to FIGS. 1-3, 5, and 6, the head/jamb window mainframe component 10 may also comprise an exterior boss 30 extending from the second surface 24 of the horizontal block 20 and disposed at one edge of the second surface of the horizontal block 20. As shown in FIG. 2, the exterior boss 30 comprises a blind stop channel 32, which is configured to receive an attachable blind stop 70 as described further below.

Further as shown in FIGS. 1-3, 5, and 6, the head/jamb window mainframe component 10 may comprise an interior boss 40 extending from the second surface 24 of the horizontal block 20. The interior boss 40 is disposed at an edge of the second surface 24 opposite the edge in which the exterior boss 30 is disposed. As used herein, "exterior boss" means the boss facing the outside of the dwelling upon installation, wherein the "interior boss" faces the inside of the home upon installation. As would be familiar to the skilled person, the exterior boss and the interior boss are components which assist in the fastening of the window mainframe component to perimeter sections of the window opening. Various bosses are contemplated. In one embodiment, the interior boss and/or the exterior boss are screw bosses.

Figure 5:
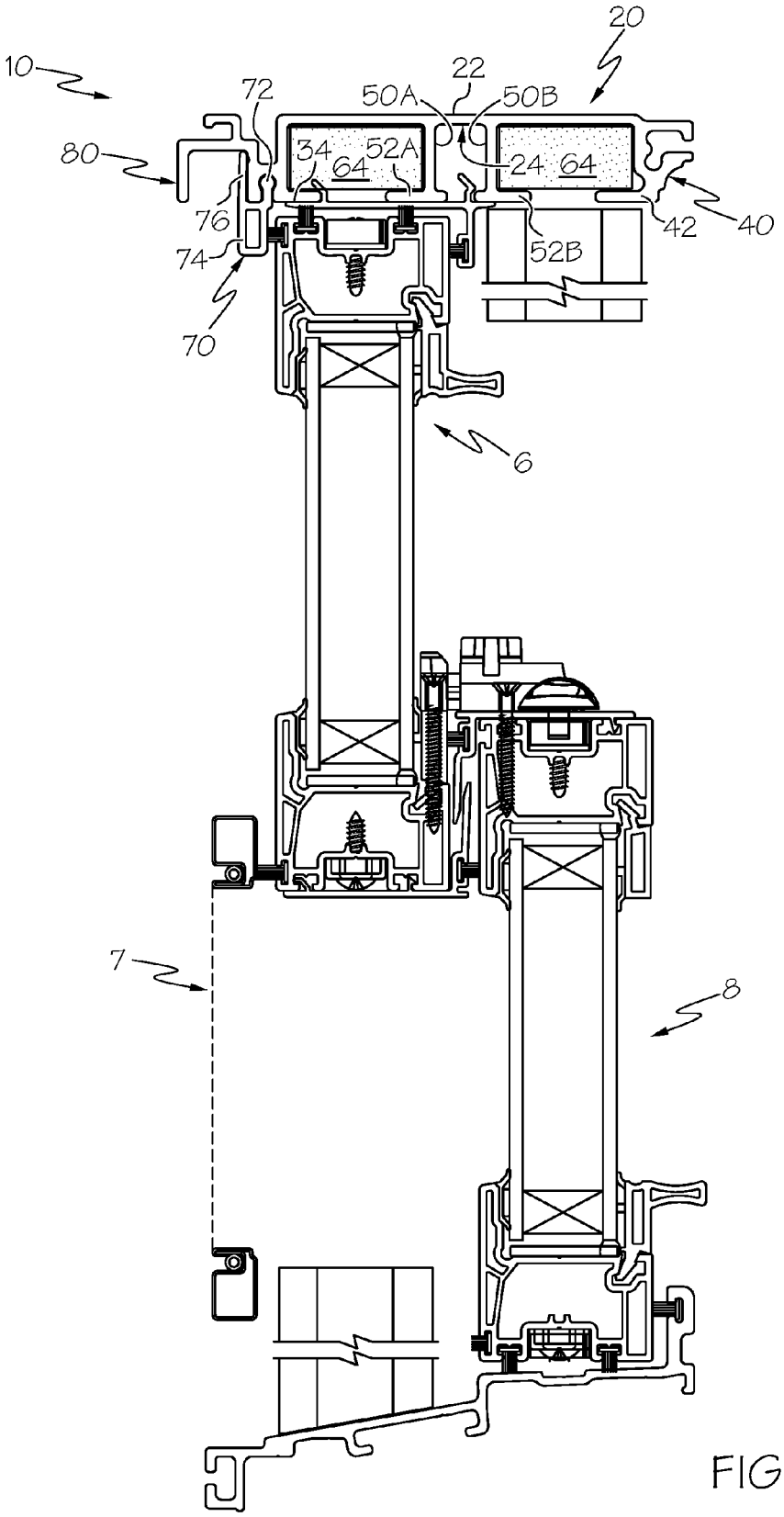
FIG. 5 is a side view illustrating a window mainframe component installed in the head of a window mainframe used to support the double hung window of FIG. 4.
Figure 6:
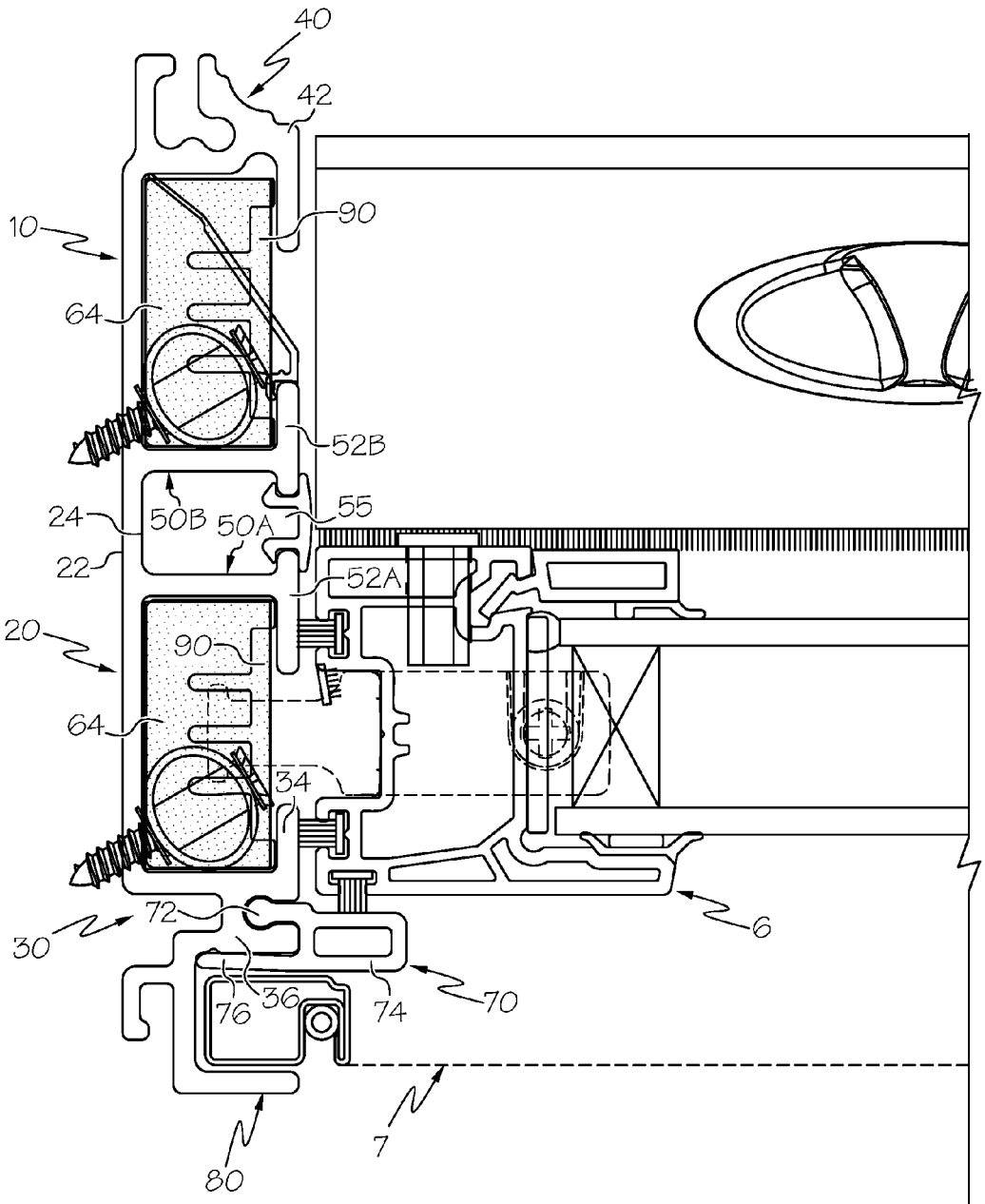
FIG. 6 is a top view illustrating a window mainframe component installed in the jamb of a window mainframe used to support the double hung window of FIG. 4.

Moreover, the head/jamb window mainframe component 10 comprises a plurality of vertical beams comprising at least a first vertical beam 50A and a second vertical beam 50B. As shown, the plurality of vertical beams 50A, 50B extend from the second surface 24 in between the interior boss 40 and the exterior boss 30. Further as shown, the first vertical beam 50A and the second vertical beam 50B are spaced apart and each have flanged ends 52A and 52B, respectively. As shown in FIGS. 5 and 6, the flanged ends 52A and 52B may be used for attachment to one or more window sashes 6, and optionally an additional blind stop.

Referring to FIGS. 1-3, the head/jamb window mainframe component 10 comprises a plurality of balance shoe tracks comprising at least a first balance shoe track 60A and a second balance shoe track 60B. The balance shoe tracks 60A and 60B are channels which house the balance shoes 64 (See FIGS. 5 and 6), which are components that attach to window balances of a window sash. Various attachment mechanisms are contemplated. Referring to FIG. 6, the top window sash 6 may have an attachment pivot bar 90 attached to the balance shoe 64. As shown in FIGS. 1-3, the first balance shoe track 60A is a channel formed in the spacing between the first vertical beam 50A and the exterior boss 30, and the second balance shoe track 60B is a channel formed in the spacing between the second vertical beam 50B and the interior boss 40. As shown, the first balance shoe track 60A and the second balance shoe track 60B have a depth or height of one inch or less. FIGS. 1 and 2 depict this track depth or height as distance h. Without being bound by theory, maintaining a depth less than one inch ensures that the head/jamb windows mainframe component 10 may be installed to meet egress requirements without expanding the window opening by removing drywall, wood or brick from the dwelling. In yet another embodiment, the depth of the first balance shoe track 60A and the second balance shoe track 60B is less than 0.9 inch. In another embodiment, the depth of the first balance shoe track 60A and the second balance shoe track 60B from 0.4 to 1.0 inches. In conventional mainframe components, such as a vinyl honeycomb structure, the height or depth is much greater than 1 inch and thus is typically unsuitable for use in replacement egress windows.

Referring to FIGS. 1 and 2, the head/jamb window mainframe component 10 comprises an attachable blind stop 70, which is a safety component which may block a window sashes from swinging outward, especially while tilting and washing the window or in storm conditions while there is negative pressure on the building. As shown in FIGS. 1 and 2, the attachable blind stop 70 may comprise a slidable flange member 72 configured to slidingly engage the blind stop channel 32 of the exterior boss 30, and a sash back stop member 74 extending a distance d beyond a horizontal plane p defined by the flanged ends 52A and 52B of the first vertical beam 50A and the second vertical beam 50B. In further embodiments, the attachable blind stop 70 comprises a support flange 76 extending vertically opposite the sash back stop member 74. Further as shown, the attachable blind stop 70 contacts an outer surface of at least one wall 36 of the blind stop channel 32 such that the at least one wall 36 is sandwiched between the slidable flange member 72 and the support flange 76.

Referring again to FIGS. 1 and 2, the head/jamb window mainframe component 10 may further comprise an additional blind stop channel 55 disposed between the first vertical beam 50A and the second vertical beam 50B. This additional blind stop 55 is typically used for double hung windows having a top window sash 6 and a bottom window sash 8 as depicted in FIG. 4. Moreover as shown in FIGS. 1-3, 5, and 6, the head/jamb window mainframe component 10 may also comprise a screen support member 80, which is proximate the exterior boss 30. FIG. 6 depicts the screen support member 80 housing the sliding screen 7.

Referring to FIGS. 2 and 3, the attachment of the head/jamb window mainframe component 10 involves fastening the head/jamb window mainframe components 10 to the window opening 5 with the attachable blind stop 70 engaged to the blind stop channel 32. Various lengths are contemplated for the attachable blind stop 70. Referring to FIG. 2, in the jamb window mainframe component, the attachable blind stop 70 may extend at least a portion of the vertical distance between the head 2 and the sill 4 (denoted as L1). In one embodiment as depicted in FIG. 2, the attachable blind stop 70 may extend downwardly from the head 2 a partial vertical distance corresponding to a height of the top window sash 6 (denoted as L2). Installing the attachable blind stop 70 as support for only the top window sash 6 may yield larger horizontal spacing within the lower half of the window frame 1 to ensure compliance with egress requirements. After installing the attachable blind stop 70 in the blind stop channel 32, the top window sash 6 and the bottom window sash 8 are attached to the head/jamb window mainframe components 10.

Referring to FIGS. 5 and 6, the back stop member 74 of the attachable blind stop 70 may extend a distance beyond the edge of the top window sash 6. In FIG. 5, the back stop member 74 of the attachable blind stop 70 may extend downwardly a vertical distance below an upper edge of the top window sash 6. In FIG. 6, the back stop member 74 of the attachable blind stop 70 extends laterally a distance beyond an outer edge of the top window sash 6.

Various compositions are contemplated for the head/jamb window mainframe component 10. It is contemplated that the attachable blind stop 70 may have the same or a different composition than the other component(s) of the head/jamb window mainframe component 10. In one embodiment, the head/jamb window mainframe component 10 comprises extruded polymer. For example and not by way of limitation, the head/jamb window mainframe component 10 may comprise one or more of fiberglass, polyvinyl chloride, acrylonitrile butadiene styrene (ABS), fiberglass, carbon fiber, wood, or aluminum. In a specific embodiment, the head/jamb window mainframe component 10 comprises fiberglass.

Unless otherwise indicated, the disclosure of any ranges in the specification and claims are to be understood as including the range itself and also anything subsumed therein, as well as endpoints.

It is noted that terms like "preferably," "commonly," and "typically" are not utilized herein to limit the scope of the claimed embodiments or to imply that certain features are critical, essential, or even important to the structure or function of the claimed embodiments. Rather, these terms are merely intended to highlight alternative or additional features that may or may not be utilized in a particular embodiment of the present disclosure.

Having described the embodiments in detail, it will be apparent that modifications and variations are possible without departing from the scope of the present disclosure defined in the appended claims. More specifically, although some aspects of the present disclosure are identified herein as preferred or particularly advantageous, it is contemplated that the present disclosure is not necessarily limited to these preferred aspects of the disclosure.

What is claimed is:

1. A head/jamb window mainframe component for egress windows comprising:

a horizontal block having a first surface configured to abut a window opening along perimeter sections of the window opening and a second surface opposite the first surface, wherein the first surface and the second surface are planar;

an exterior boss directly extending from the second surface and disposed at one edge of the second surface of the horizontal block, wherein the exterior boss comprises a blind stop channel;

an interior boss directly extending from the second surface and disposed at an edge of the second surface opposite the edge in which the exterior boss is disposed;

a plurality of vertical beams comprising at least a first vertical beam and a second vertical beam, the plurality of vertical beams extending from the second surface in between the interior boss and the exterior boss, wherein the first vertical beam and the second vertical beam are spaced apart and each have flanged ends operable for attachment to a window sash;

a plurality of balance shoe tracks comprising at least a first balance shoe track and a second balance shoe track, wherein the first balance shoe track is a channel formed in spacing between the first vertical beam and the exterior boss, and the second balance shoe track is a channel formed in spacing between the second vertical beam and the interior boss, wherein the first balance shoe track and the second balance shoe track have a depth of one inch or less; and an attachable blind stop comprising a slidable flange member configured to slidingly engage the blind stop channel of the exterior boss, and a sash back stop member extending a distance beyond a horizontal plane defined by the flanged ends of the first vertical beam and the second vertical beam.

2. The head/jamb window mainframe component of claim 1 wherein the attachable blind stop comprises a support flange extending vertically opposite the sash back stop member and contacting an outer surface of at least one wall of the blind stop channel such that the at least one wall is sandwiched between the slidable flange member and the support flange.

3. The head/jamb window mainframe component of claim 1 wherein the interior boss is an interior screw boss.

4. The head/jamb window mainframe component of claim 1 wherein the exterior boss is an exterior screw boss.

5. The head/jamb window mainframe component of claim 1 wherein the depth of the first balance shoe track and the second balance shoe track is less than 0.9 inch.

6. The head/jamb window mainframe component of claim 1 wherein the first balance shoe track and the second balance shoe track have a depth of 0.4 to 1.0 inches.

7. The head/jamb window mainframe component of claim 1 wherein the head/jamb window mainframe component comprises extruded polymer.

8. The head/jamb window mainframe component of claim 1 wherein the head/jamb window mainframe component comprises fiberglass.

9. The head/jamb window mainframe component of claim 1 wherein the attachable blind stop comprises one or more of polyvinyl chloride, acrylonitrile butadiene styrene (ABS), fiberglass, carbon fiber, wood, or aluminum.

10. The head/jamb window mainframe component of claim 1, further comprising an additional blind stop channel disposed between the first vertical beam and the second vertical beam.

11. An egress window assembly comprising:

a window opening;

a window mainframe attached along a perimeter of the window opening, the window mainframe comprising a head jamb, a sill, and side jambs disposed therebetween, wherein the head jamb, the side jambs, or both comprise a head/jamb window mainframe component, the head/jamb window mainframe component comprising:

a horizontal block having a first surface abutting the window opening and a second surface opposite the first surface, wherein the first surface and the second surface are planar;

an exterior boss extending directly from the second surface and disposed at one edge of the second surface of the horizontal block, wherein the exterior boss comprises a blind stop channel;

an interior boss extending directly from the second surface and disposed at an edge of the second surface opposite the edge in which the exterior boss is disposed;

a plurality of vertical beams comprising at least a first vertical beam and a second vertical beam, the plurality of vertical beams extending from the second surface in between the interior boss and the exterior boss, wherein the first vertical beam and the second vertical beam are spaced apart and each have flanged ends operable for attachment to a window sash;

a plurality of balance shoe tracks comprising at least a first balance shoe track and a second balance shoe track, wherein the first balance shoe track is a channel formed in spacing between the first vertical beam and the interior boss, and the second balance shoe track is a channel formed in spacing between the second vertical beam and the exterior boss, wherein the first balance shoe track and the second balance shoe track have a depth of one inch or less;

an attachable blind stop comprising a slidable flange member configured to slidingly engage the blind stop channel of the exterior boss, and a sash back stop member extending a vertical distance beyond a horizontal plane defined by the flanged ends of the first vertical beam and the second vertical beam; and a window sash attached to window mainframe, wherein at least a portion of the sash back stop member extends a distance beyond an upper edge of the window sash.

12. The egress window assembly of claim 11, wherein the attachable blind stop comprises a support flange extending vertically opposite the sash back stop member and contacting an outer surface of at least one wall of the blind stop channel such that the at least one wall is sandwiched between the slidable flange member and the support flange.

13. The egress window assembly of claim 11, wherein the interior boss is an interior screw boss.

14. The egress window assembly of claim 11, wherein the exterior boss is an exterior screw boss.

15. The egress window assembly of claim 11, wherein the depth of the first balance shoe track and the second balance shoe track is less than 0.9 inch.

16. The egress window assembly of claim 11, wherein the first balance shoe track and the second balance shoe track have a depth of 0.4 to 1.0 inches.

17. The egress window assembly of claim 11, wherein the head/jamb window mainframe component comprises extruded polymer.

18. The egress window assembly of claim 11, wherein the head/jamb window mainframe component comprises fiberglass.

19. The egress window assembly of claim 11, wherein the attachable blind stop comprises one or more of polyvinyl chloride, acrylonitrile butadiene styrene (ABS), fiberglass, carbon fiber, wood, or aluminum.

20. The egress window assembly of claim 11, further comprising an additional blind stop channel disposed between the first vertical beam and the second vertical beam.

* * * * *